US006519998B2

(12) United States Patent
Ertl et al.

(10) Patent No.: US 6,519,998 B2
(45) Date of Patent: Feb. 18, 2003

(54) RADIAL PRESS

(75) Inventors: Fritz Ertl, Friedrichsdorf (DE); Georg Grundmeier, Karben (DE)

(73) Assignee: Uniflex-Hydraulik GmbH, Karben (DE)

( * ) Notice: Subject to any disclaimer, the term of this patent is extended or adjusted under 35 U.S.C. 154(b) by 0 days.

(21) Appl. No.: 10/038,695

(22) Filed: Jan. 2, 2002

(65) Prior Publication Data

US 2002/0056307 A1 May 16, 2002

Related U.S. Application Data

(63) Continuation of application No. 09/673,825, filed as application No. PCT/EP99/00959 on Feb. 13, 1999, now abandoned.

(30) Foreign Application Priority Data

Apr. 22, 1998 (DE) ..... 19817882

(51) Int. Cl.[7] ..... B21D 41/02
(52) U.S. Cl. ..... 72/402; 72/452.9; 29/237
(58) Field of Search ..... 72/402, 452.9, 72/452.8, 453.16, 416; 29/237

(56) References Cited

U.S. PATENT DOCUMENTS

| | | | |
|---|---|---|---|
| 3,455,140 A | 7/1969 | Galan | |
| 3,731,518 A | 5/1973 | Blocher | |
| 4,785,656 A | 11/1988 | Kennedy | |
| 4,854,031 A | 8/1989 | Eisenzimmer | |
| 5,209,100 A | 5/1993 | Dischler | |

FOREIGN PATENT DOCUMENTS

| | | | |
|---|---|---|---|
| DE | 28 44 475 | 4/1980 | |
| DE | 39 06 107 | 8/1990 | |
| DE | 41 35 465 | 4/1993 | |
| FR | 2641211 | 7/1990 | |
| JP | 57-109536 | 7/1982 | ..... 72/402 |
| SU | 424649 | 4/1974 | ..... 72/402 |
| SU | 1094653 | 5/1984 | ..... 72/402 |

*Primary Examiner*—Daniel C. Crane
(74) *Attorney, Agent, or Firm*—Katten Muchin Zavis Rosenman

(57) ABSTRACT

A radial press comprises two press yokes and eight crimping members. The yokes are arranged on a plane that is perpendicular to the press axis and are located diametrically opposite the press axis and can be moved towards each other in a straight line by means of a drive unit, whereby the direction of movement is perpendicular to the press axis. At least one part of the crimping members that are disposed in the yokes has slide surfaces that respectively cooperate with a control surface of one of the yokes or an adjacent crimping member in such a way that all of the crimping members can be moved in a uniform manner onto the press axis when the press yokes move closer to each other. Two crimping members arranged perpendicular to the direction of movement of the at least one movable press yoke are divided into two segments.

11 Claims, 4 Drawing Sheets

RADIAL PRESS

CROSS-REFERENCES TO RELATED APPLICATIONS

This is a continuation of U.S. application Ser. No. 09/673,825, filed Oct. 20, 2000, which is a 371 of PCT/EP99/00959, filed Feb. 13, 1999.

FIELD OF THE INVENTION

The present invention relates to a radial press with two press yokes and eight crimping members, where the press yokes are arranged in a plane that is perpendicular to the press axis, are located diametrically opposite one another relative to the press axis, and can be moved towards one another in a straight line by means of a drive unit, in a direction of movement that runs perpendicular to the press axis, and where furthermore six of the crimping members mounted in the press yokes have slide surfaces that interact with a control surface of a press yoke or an adjacent crimping member, in each instance, in such a way that all of the crimping members are uniformly moved toward the press axis when the two press yokes move closer to one another, and wherein two of said eight crimping members are diametrically opposed to one another on said first press yoke and said second press yoke in the direction of movement of said first press yoke and are in a stationary position with respect to said respective press yoke.

BACKGROUND OF THE INVENTION

Such a radial press is known from the German Offenlegungsschrift [laying-open statement] 4135465. As compared with those radial presses in which the crimping members are controlled by means of at least one conical pressure ring that is moved parallel to the press axis (e.g. DE-OS 2844475), radial presses of the type indicated above are characterized by a relatively low construction depth (expanse in the direction of the press axis); this is a decisive advantage with regard to application possibilities of the press. However, known radial presses of the type indicated above require a relatively large construction volume, for which reason only stand presses have been implemented until now, in which large hydraulic cylinders are arranged in the stand housing. This also holds true for the radial press known from U.S. Pat. No. 4,785,656. Furthermore, at least in the radial press of the type indicated above, according to DE-OS 4135465, only axial loading and unloading of the press is possible. This results in that only small-sized fittings may be attached to hoses with that radial press.

SUMMARY OF THE INVENTION

The task on which the present invention is based is derived from these facts, and consists of creating a radial press of the type stated initially, that allows to attach larger fittings to hoses. A further object is to provide for a radial press of the type stated initially that can be implemented as a tool of an industrial robot.

This task is accomplished, according to the invention, in that those two crimping members which are arranged perpendicular to the direction of movement of said first press yoke are divided into two crimping member segments, each of said crimping member segments being slidably guided along said first control surface of the associated first and second press yoke respectively. This design allows to open the radial press such far that larger dimensions fittings may be loaded and unloaded axially. In addition, the structure of the radial press according to the invention makes other particularly preferred further developments possible, which, as will be explained below, demonstrate very significant advantages for practical work, as compared with the state of the art.

In accordance with a preferred further development, both press yokes of the radial press according to the invention are movable with respect to the housing. In this manner, a radial press with a dual press stroke is obtained, without the construction size increasing too greatly. This is particularly advantageous if a radial loading opening is provided (see below). Furthermore, in such a radial press according to the invention, equipped with two movable press yokes, it is advantageous that the press axis is not displaced during the pressing process, if the press is structured symmetrically. This is advantageous, in particular if the press is used in connection with an industrial robot. However, it should be emphasized at this point that a radial press according to the invention, equipped with two movable press yokes, by no means necessarily has to be structured symmetrically. Instead, the drive units assigned to the two press yokes can certainly be structured differently. In this case, one press yoke could be used for fast adjustment of the crimping members, while the other press yoke could be used for a power adjustment of the crimping members.

In accordance with the radial press according to the invention, the latter has a common housing in which the first press yoke is guided so as to be movable. If the radial press according to the invention has (only) one movable press yoke, it is practical if the other press yoke is mounted fixed in place in the housing. In connection with the extremely compact construction of the radial press as explained above, such a common housing results in a high degree of rigidity, so that even relatively small radial presses can work at high forces.

The very compact structural design of the radial press according to the invention even makes it possible for the housing to have a radial loading opening on one side, in accordance with another preferred embodiment of the invention. Even the interruption in the (otherwise essentially closed) housing caused by such a radial loading opening on one side does not result in an impermissibly great reduction in rigidity of the radial press according to the invention, because of its extremely compact construction. However, the possibility of radial loading of the radial press is a very significant advantage, for practical work, as compared with those radial presses that can only be loaded axially, since in this way the radial press is also suitable for processing of work pieces that cannot be drawn through the die because of their complicated shape, for example if pressing is to be performed in the center of a hose. Also, the radial loading opening makes this further development of the radial press according to the invention particularly suitable for automated use, for example in that the radial press is arranged on the arm of an industrial robot, as a pressing die. Because of its radial loading opening, the radial press can be passed from the side over pre-installed work pieces, mounted in a suitable device. As compared with the state of the art, this allows a significant improvement in the efficiency of production, in that a plurality of work pieces is made available on a suitable device, for automatic processing with the radial press according to the invention. Axial loading, which was required until now, and can only be performed by hand, particularly in the case of soft pieces that bend easily, such as hoses or the like, can be eliminated when using a further development of the radial press according to the invention, with a radial loading opening as explained above.

The radial loading opening on one side, as explained above, is arranged perpendicular to the direction of movement of the press yokes as they move towards one another and is adjacent to one of said two crimping members which is divided into two crimp member segments.

Also with regard to as compact a construction of the radial press according to the invention as possible, another further development of the latter is characterized in that the at least one drive unit comprises a hydraulic piston that is guided in a segment of the housing structured as a hydraulic cylinder, forming a seal. For this purpose, the hydraulic piston can be wedge-shaped, in order to make a wedge gear mechanism available that acts to convert its movement into a movement of the press yoke in question. The result is an extreme degree of compactness of the radial press.

The minimal dimensions of the radial press according to the invention, particularly its especially small construction height in the axial direction, make it possible that two or more radial presses can be arranged very closely next to each other. With a system of several radial presses of the type according to the invention, arranged in parallel, it is therefore possible to carry out even very closely adjacent pressing processes synchronously, which is a significant advantage for practical operations, because of the time that is gained. For this purpose, according to yet another further development of the invention, at least two radial presses according to the invention are mounted adjacent to each other on a common guide, at a distance along the press axis relative to each other, where the distance between the presses can be quickly adjusted, either manually or automatically, by means of a suitable structure of the guide.

BRIEF DESCRIPTION OF THE DRAWINGS

In the following, the present invention will be explained in greater detail, using two particularly preferred exemplary embodiments shown in the drawing. The drawing shows.

DETAILED DESCRIPTION OF THE PREFERRED EMBODIMENTS

Figure 1:
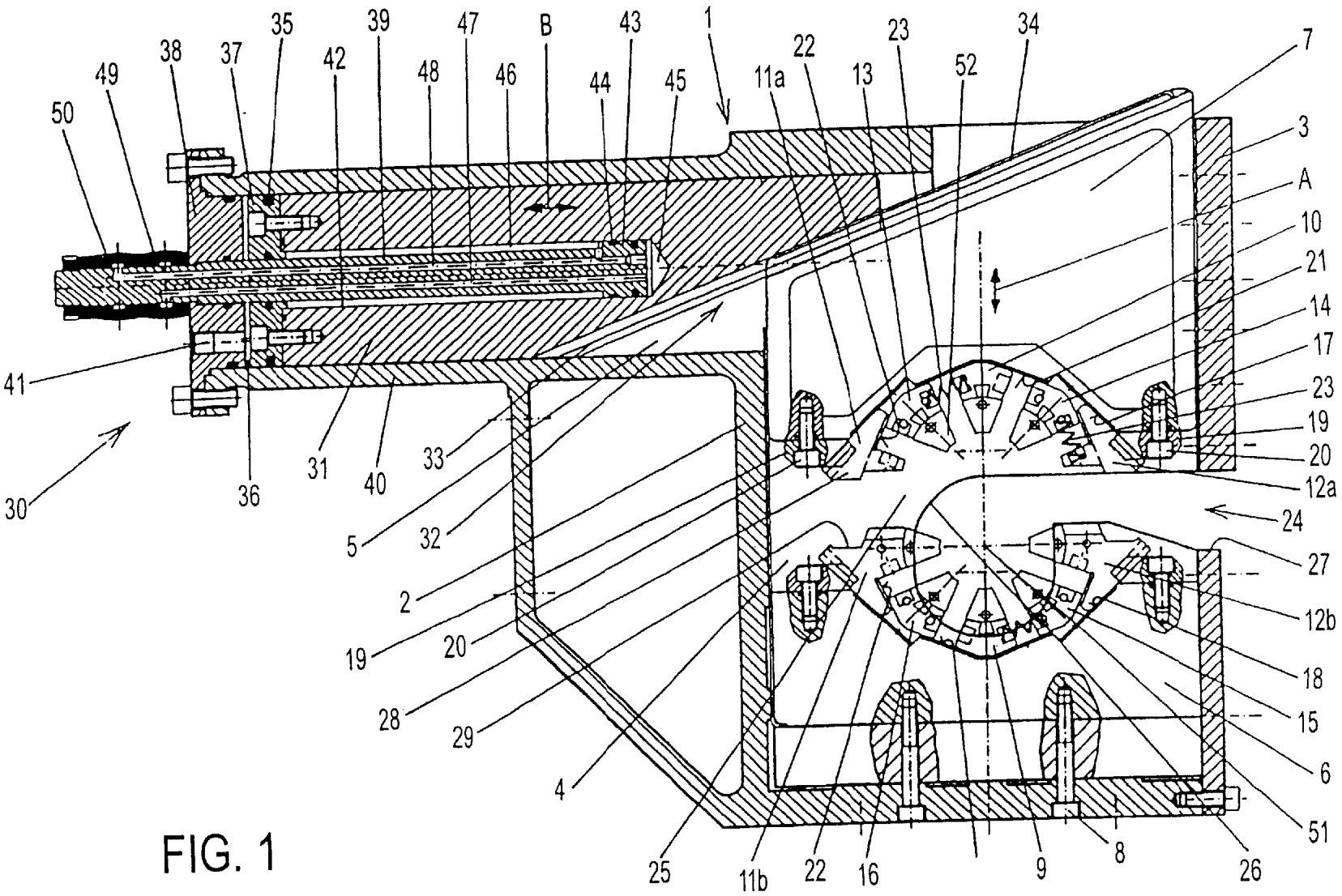
FIG. 1 a longitudinal cross-section through a radial press with a cross slide, with the radial loading opening being open, FIG. 2 the radial press according to FIG. 1 during the closing process, with the radial loading opening already being closed, FIG. 3 the radial press according to FIGS. 1 and 2 at the end of the pressing process, and FIG. 4 a longitudinal cross-section through a radial press according to the invention, with two cross slides.
Figure 2:
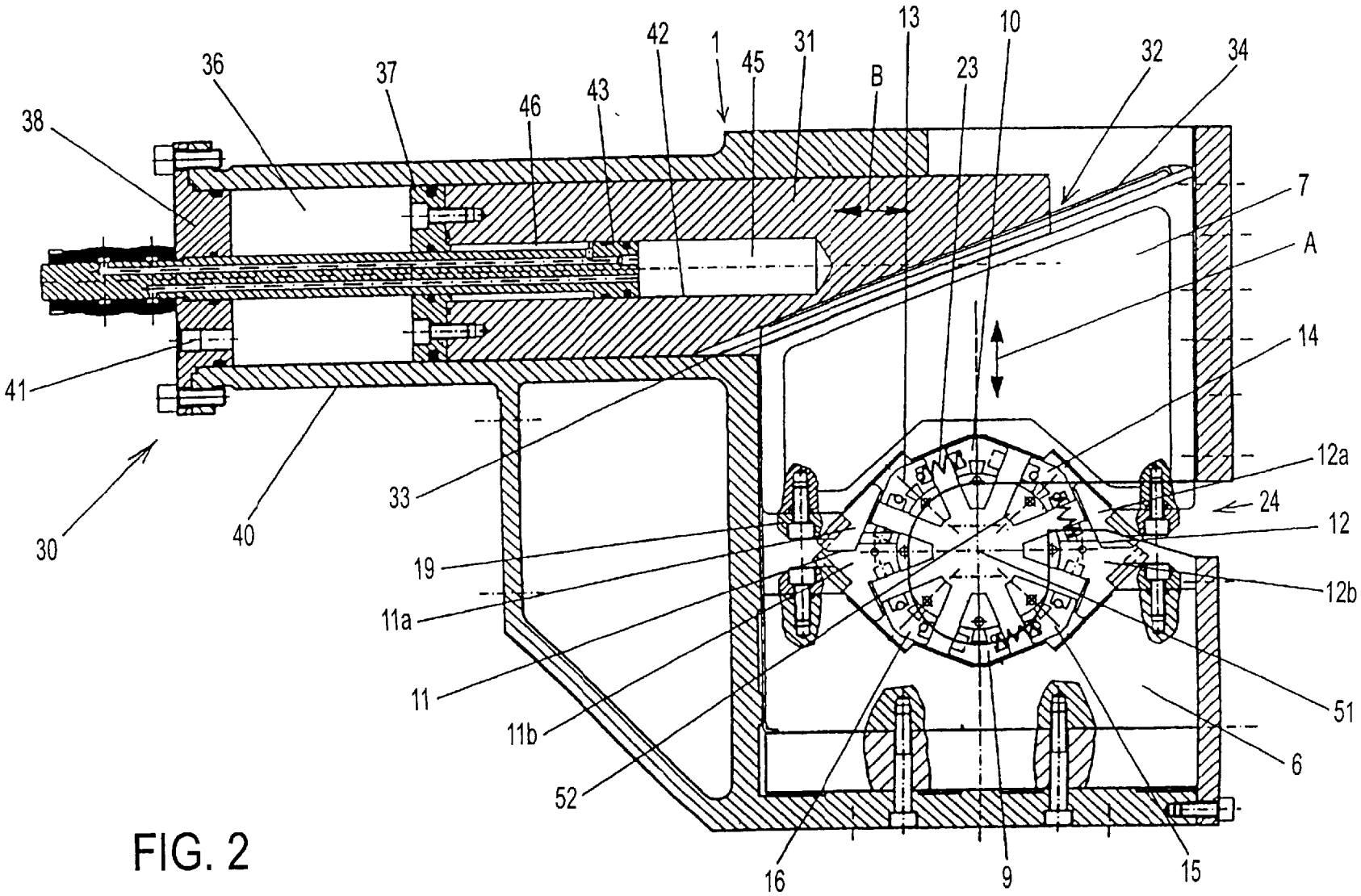
Figure 3:
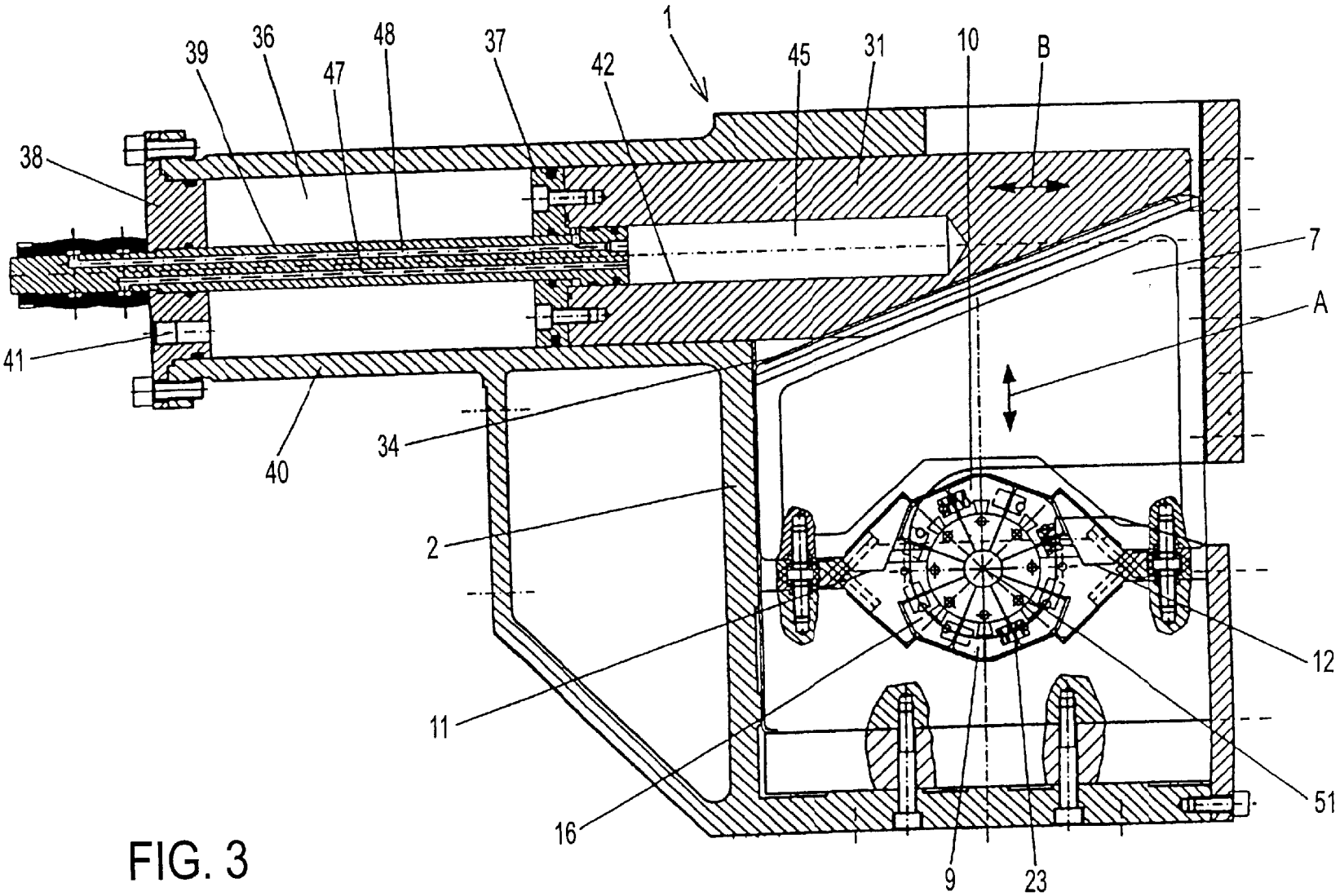

The radial press shown in FIGS. 1 to 3 of the drawing comprises a housing 1 with an L-shaped footprint. The housing comprises a base element 2 and a two-part cover lid 3 that is screwed onto the former. In this connection, the housing essentially defines two cavities, namely a cube-shaped cavity 4 and a round, cylindrical cavity 5 that extends at a right angle to the former.

Two press yokes 6 and 7 are contained in the cube-shaped cavity 4 of the housing 1. In this connection, the lower press yoke 6 is rigidly connected with the housing by means of screws 8. In contrast, the upper press yoke 7 is guided in the housing 1 so as to be movable, where the direction of movement of the two press yokes 6 and 7 relative to one another is indicated with the double arrow A.

Eight crimping members, in total, are mounted in the two press yokes 6 and 7. In this connection, each crimping member consists of a block member 11 to 16 and a replaceable crimp member replacement part 52. The six block members 9, 10, 13, 14, 15, and 16 are not divided, while, as will be explained in greater detail below, the block members 11 and 12 of two crimping members are each divided into two segments 11*a* and 11*b*, 12*a* and 12*b*, respectively. A spiral spring 23 is arranged between every two adjacent block members, in a corresponding pocket, in each instance. The block member 9 is mounted fixed in place in the lower press yoke 6, and the block member 10 is mounted fixed in place in the upper press yoke 7. The block members 11 and 12 are divided, as briefly mentioned above, and comprise the segments 11*a* and 11*b*, 12*a* and 12*b*, respectively. The block member segments 11*a* and 12*a* assigned to the upper press yoke 7 are guided so as to be movable along the support surfaces 17, which enclose an angle of 45° with the direction A of movement. Analogously, the block member segments 11*b* and 12*b* assigned to the lower press yoke 6 are mounted so as to be movable along the support surfaces 18. In this connection, guide elements 19 are provided to guide the block member segments 11*a*, 11*b*, 12*a*, and 12*b*, and these are connected with the upper press yoke 7 and the lower press yoke 6 by means of a screw 20, in each instance. In this connection, the guide elements 19 and the related block member segments engage with each other via a T guide; in addition to guiding the block member segments, the guide elements 19 limit the sliding movement of the block member segments on the support surfaces 17 and 18, respectively, in the maximum open position shown in FIG. 1. In this connection, the block member segments 11*a* and 12*a* assigned to the upper press yoke 7 are each guided by two guide elements 19, which are arranged at a distance from one another in such a way that the guide elements 19 that serve to guide the block member segments 11*b* and 12*b* assigned to the lower press yoke 6 can each penetrate into the space between two opposite guide elements when the press is closed (FIG. 3).

The block members 13 to 16 are each guided on a support surface 21 of the upper press yoke 7 and lower press yoke 6, and, on the other hand, on a support surface 22 of the adjacent block member segment 11*a*, 11*b*, 12*a*, or 12*b*.

The division of the block members 11 and 12 into the block member segments 11*a* and 12*a*, assigned to the upper press yoke 7, on the one hand, and the block member segments 11*b* and 12*b*, assigned to the lower press yoke 6, on the other hand, is related to the radial loading opening 24 provided on one side of the housing 1. This opening is defined, in each instance, by a recess 26 provided in the side walls 25 that define the cube-shaped cavity 4 of the housing, and a perforation 27 of the cover lid 3. When the press is open (FIG. 1), a work piece to be processed can be placed into the press through the radial loading opening 24. When the press is closed (FIG. 2), the block member segments 11*a* and 11*b*, as well as 12*a* and 12*b*, come together to form a block member, in each instance. In this connection, an adjustment projection 28 of the block member segments 11*a* and 12*a*, in each instance, enters into a corresponding adjustment recess 29 of the block member segments 11*b* and 12*b*; in this manner, the block member segments that are assigned to one another are precisely aligned relative to one another when the press is closed.

The drive unit 30 of the radial press comprises a cross slide 31 that is guided to be movable within the round, cylindrical cavity 5. In this connection, the direction B of movement of the cross slide 31 is perpendicular to the direction A of movement of the upper press yoke 7. A deflection device 32, structured as a wedge gear mechanism, serves to transfer the movement of the cross slide 31 into a movement of the upper press yoke 7. The wedge gear mechanism comprises a slanted guide 33 in the form of a T profile, and a corresponding slanted guide 34 of the upper press yoke 7 that is in engagement with the slanted guide 33 of the cross slide 31.

The cross slide 31 is structured as a hydraulic piston that is sealed with ring seals 35 relative to the inside wall of the round, cylindrical cavity 5 of the housing 1. A hydraulic work space 36, which is defined by the cross slide lid 37, the housing lid 38, the piston rod 39, and the cylindrical segment 40 of the housing 1, serves as the power drive for the cross slide 31. A connection bore 41 opens into the hydraulic work space 36; the hydraulic work space 36 can be connected with a source for a pressure medium via this bore.

The cross slide 31 has a longitudinal bore 42. The sealing head 43 of the piston rod 39 is guided in this bore, forming a seal. In this connection, the seal is formed by means of two ring seals 44. The sealing head 43 divides the longitudinal bore 42 of the cross slide into two hydraulic work spaces, namely an advancing work space 45 and a retraction work space 46. In this connection, the latter is defined by the inside wall of the longitudinal bore 42, the outside wall of the piston rod 39, the sealing head 43, and the cross slide lid 37. In this connection, the two hydraulic work spaces 45 and 46 are components of a so-called fast drive, with which the cross slide 31 can be moved to quickly close and open the press at a relatively high speed. For this purpose, the piston rod 39 has two hydraulic channels 47 and 48. In this connection, the hydraulic channel 47 is connected with the hydraulic work space 45, and the hydraulic channel 48 is connected with the hydraulic work space 46. The two hydraulic channels 47 and 48 can be connected with a source for a pressure medium via connection nipples 49 and 50.

If the completely open press (FIG. 1), with the radial loading opening 24 fully exposed, is closed by moving the cross slide 31, the position of the block members 9 to 16 remains unchanged, relative to the related press yoke 6 or 7, until the block member segments 11*a* and 11*b*, as well as 12*a* and 12*b*, come together (FIG. 2). If the two press yokes 6 and 7 are moved further towards one another, this results in a uniform movement of all the crimping members (block members plus crimping member replacement parts), as known from the state of the art, in the direction of the press axis, where the block members 11 to 16 slide on the related support surfaces of the press yoke in question, or on an adjacent block member, with their slide surfaces, in each instance.

Figure 4:
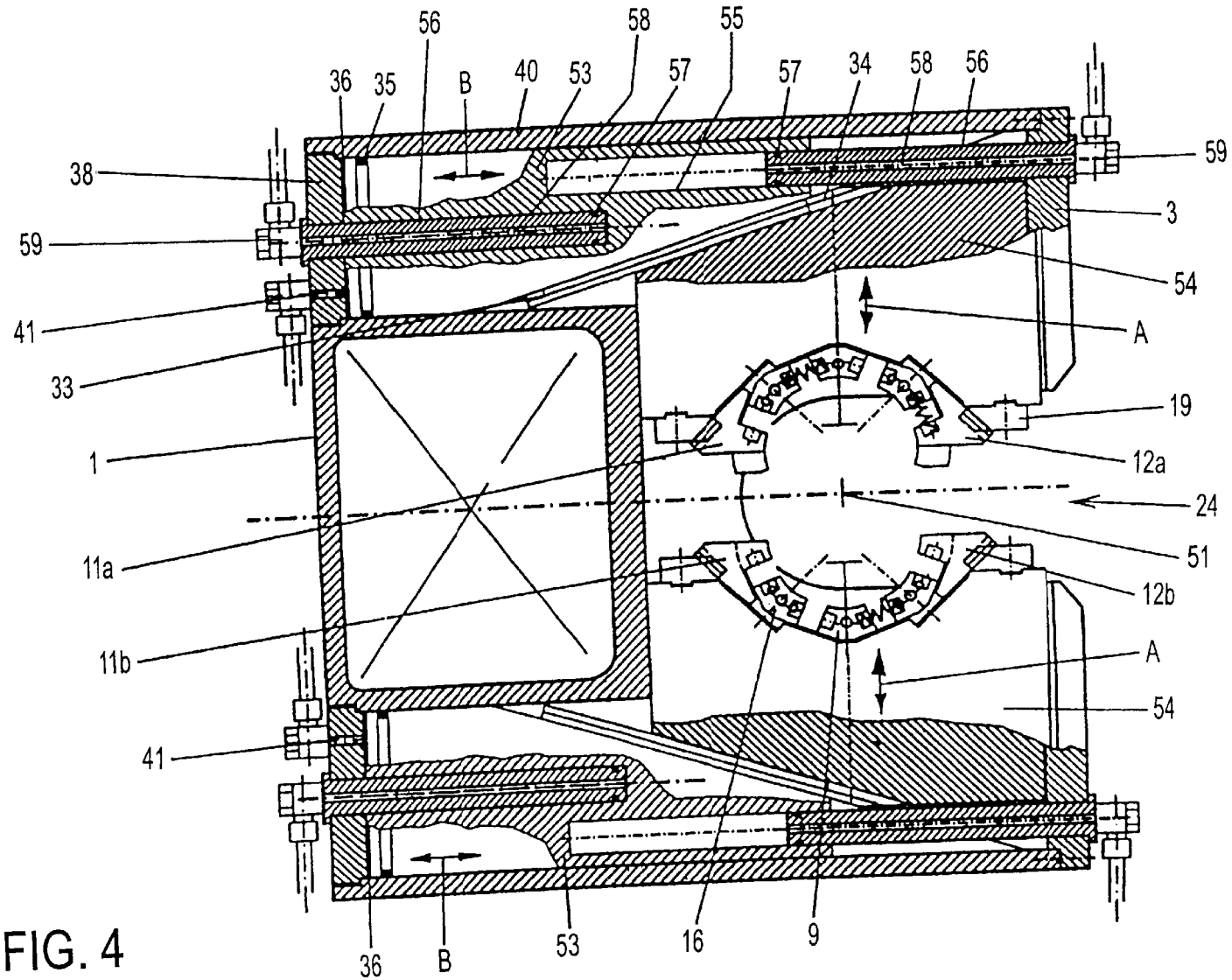

The radial press according to FIG. 4 differs from the radial press shown in FIGS. 1 to 3 and explained above primarily in that two cross slides 53 are provided. Both cross slides 53 are each guided so as to be movable in a cylindrical segment 40 of the housing 1 (double arrow B). Analogously, both press yokes 54 are also guided so as to be movable in the housing 1 (double arrow A).

Analogous to the deflection device 32 implemented in the radial press according to FIGS. 1 to 3, a wedge gear mechanism is provided as the deflection device 32, in each instance, also in the case of the radial press according to FIG. 4. This mechanism is structured as a forced coupling of the cross slide 53 in question with the related press yoke 54, in each instance, in that the slanted guides 33 and 34 of the cross slide 53 and the press yoke 54 are structured in T shape and are in engagement with each other. In the exemplary embodiment shown in FIG. 4, the wedge angles of the two wedge gear mechanisms are identical, so that the two press yokes 54 are moved towards one another at the same speed when there is a synchronous movement of the two cross slides 53, so that the press axis 51 does not shift as the press is closed (or opened).

Furthermore, the radial press according to FIG. 4 differs significantly from the one according to FIGS. 1 to 3 in terms of the structure of the cross slide 53, particularly in connection with the fast drive. Here, each cross slide 53 has two longitudinal bores 55 that are directed in opposite directions from one another and offset relative to one another, each of them structured as a dead-end bore. A piston rod 56 is guided in each longitudinal bore 55, forming a seal, where the seal is formed by means of a ring seal 57. Of the two piston rods 56 assigned to each cross slide 53, one is rigidly connected with the cover lid 3, which again is in two parts, and the other is rigidly connected with a housing lid 38 that closes off the cylindrical segment 40 of the housing 1 in question. Each of the two piston rods 56 has a hydraulic channel 58 passing through it, which opens into the hydraulic work space formed by the related longitudinal bore 55. Both hydraulic channels 58 can be connected with a source for a pressure medium, not shown, via a connection nipple 59, in each instance. As compared with the version of the fast drive implemented in the radial press according to FIGS. 1 to 3, the version shown in FIG. 4 has the advantage of a spatial separation of the fast drive for opening the press, on the one hand, and the fast drive for closing the press, on the other hand. For power pressing, the same high pressure can be applied to the work space 36 that acts on the face of the cross slide 53, which space is provided exclusively for the power drive, and into which the connection bore 41 opens, as well as to the hydraulic work space provided for the fast drive in the closing direction, without any risk that hydraulic fluid can penetrate into the hydraulic work space that is assigned to the fast drive for opening the press, to which no pressure is applied during pressing. With this background, in connection with sealing the cross slide 53 relative to the piston rods 56, significantly less effort is required than in the case of the design according to FIGS. 1 to 3. Also, differing from the cross slide 31 of the radial press according to FIGS. 1 to 3, the cross slide 53 itself can be structured in one piece.

Aside from the fact that in the radial press according to FIG. 4, the removable crimping member replacement parts 52 (see FIGS. 1 to 3) are not shown, there is no basic deviation of the radial press according to FIG. 4 from the one according to FIGS. 1 to 3, other than the differences explained above. This particularly holds true for the division of the block members 11 and 12 into two segments 11*a* and 11*b*, 12*a* and 12*b*, respectively, which is provided in connection with the radial loading opening 24. To avoid repetition, reference is therefore made to the explanations for FIGS. 1 to 3.

At this point, it is noted once again that the radial presses shown in the drawings are merely exemplary, particularly preferred embodiments of the invention. It is evident that comprehensive modifications are possible within the scope of the present invention. For example, the at least one cross slide can be moved by means of a spindle driven by an electric motor, instead of by means of a hydraulic drive. Also, for example, an articulated lever gear mechanism or an eccenter can convert the movement of the at least one cross slide into a movement of the related press yoke, instead of the wedge gear mechanism. Furthermore, in application cases where radial loading of the radial press is not required, the loading opening can be eliminated, and in this case, a division of the corresponding crimping members is obviously not required. Finally, it is optional, within the scope of the present invention, whether the crimping members are made in one piece or, as explained above, comprise a block member and a replaceable crimping member replacement part, in each instance.

We claim:

1. A radial press comprising:

a housing, a first press yoke and a second press yoke, each press yoke having first control surfaces and second control surfaces, said press yokes being disposed within said housing; and eight crimping members provided in said first and second press yokes and arranged uniformly around a press axis;

each of said press yokes being arranged opposite one another in a plane that is perpendicular to said press axis, at least said first press yoke being movable with respect to the housing such that both press yokes are movable with respect to each other, via a drive unit, in a direction that runs perpendicular to the press axis;

six of said eight crimping members further comprising slide surfaces that interact with said control surfaces of said press yokes such that said eight crimping members are uniformly moved toward the press axis when the press yokes move toward each other;

wherein two crimping members of said eight are diametrically opposed to one another on said first press yoke and said second press yoke in the direction of movement of said first press yoke, and are in a stationary position with respect to said respective press yokes; and wherein those two crimping members of said eight which are arranged perpendicular to the direction of movement of said first press yoke are each divided into two crimping member segments, each of said crimping member segments being slidably guided along said first control surface of the associated first and second press yokes respectively.

2. A radial press in accordance with claim 1, wherein each of said four crimping member segments further comprise centering elements that correspond to one another.

3. A radial press in accordance with claim 1, wherein said housing further comprises a radial load opening on one side, arranged perpendicularly to the direction of movement of the press yokes and adjacent one of the two crimping member divided into two segments.

4. A radial press in accordance with claim 1, wherein there are defined four crimping members of said eight that are angularly arranged at a 45° angle with respect to the direction of movement of the at least one movable press yoke, each of said angularly arranged crimping members being disposed on a respect press yoke, each of said angularly arranged crimping members being guided by a first support surface on said respective press yoke and a second support surface on said adjacent crimping member segment.

5. A radial press in accordance with claim 1, wherein only one of said first and second yokes is moveable within said housing.

6. A radial press in accordance with claim 1, wherein both of said first and second yokes are moveable within said housing.

7. A radial press in accordance with claim 1, further comprising guide elements provided on said press yokes that limit the sliding movement of said crimping member segments with respect to said respective press yokes.

8. A radial press in accordance with claim 1, wherein said radial press is arranged on an arm of an industrial robot.

9. A radial press in accordance with claim 1, wherein said drive unit is an electromechanical drive unit.

10. A radial press in accordance with claim 1, wherein said drive unit is a hydraulic drive unit.

11. A radial press system comprising at least two radial presses in accordance with claim 1 arranged on a joint guide at an adjustable distance from each other.

* * * * *